US011313635B2

(12) United States Patent
Robinson

(10) Patent No.: US 11,313,635 B2
(45) **Date of Patent: *Apr. 26, 2022**

(54) LEVER-COUPLED DEVICE FOR SELECTIVELY PREVENTING A FIREARM FROM DISCHARGING

(71) Applicant: WHG Properties, LLC, North Wales, PA (US)

(72) Inventor: Frank E. Robinson, Schwenksville, PA (US)

(73) Assignee: WHG PROPERTIES, LLC, North Wales, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/239,754

(22) Filed: Apr. 26, 2021

(65) Prior Publication Data

US 2021/0404758 A1 Dec. 30, 2021

Related U.S. Application Data

(63) Continuation of application No. 16/375,547, filed on Apr. 4, 2019, now Pat. No. 11,015,893.

(51) Int. Cl.
*F41A 17/42* (2006.01)

(52) U.S. Cl.
CPC ..... *F41A 17/42* (2013.01)

(58) Field of Classification Search
CPC ..... F41A 17/36; F41A 17/42
See application file for complete search history.

(56) References Cited

U.S. PATENT DOCUMENTS

| | | | | |
|---|---|---|---|---|
| 2,035,539 | A | 3/1936 | Dicke et al. | |
| 3,155,004 | A * | 11/1964 | Jennie | F41A 9/52 89/128 |
| 3,972,142 | A | 8/1976 | Kawamura | |
| 4,133,128 | A | 1/1979 | Brush | |
| 5,551,180 | A * | 9/1996 | Findlay | F41A 17/32 42/70.01 |
| 6,212,814 | B1 | 4/2001 | Lambie | |
| 7,261,029 | B1 * | 8/2007 | Davis | F41A 17/36 89/138 |
| 8,985,005 | B1 | 3/2015 | Dubois et al. | |
| 9,995,549 | B1 * | 6/2018 | Hamby | F41A 35/06 |
| 10,030,924 | B1 | 7/2018 | Smith | |
| 10,401,102 | B1 | 9/2019 | Carroll | |
| 10,488,136 | B2 * | 11/2019 | Sullivan | F41A 17/16 |
| 10,557,678 | B2 * | 2/2020 | Barrett | F41A 17/42 |
| 11,187,475 | B2 * | 11/2021 | Romano | F41A 3/66 |
| 2010/0236394 | A1 | 9/2010 | Gomez | |
| 2011/0283580 | A1 | 11/2011 | Esch | |
| 2014/0311004 | A1 | 10/2014 | Barrett | |
| 2018/0087860 | A1 | 3/2018 | Sullivan et al. | |

(Continued)

*Primary Examiner* — Gabriel J. Klein
(74) *Attorney, Agent, or Firm* — Fox Rothschild LLP

(57) ABSTRACT

The present disclosure generally relates to a bolt catch device that prevents the bolt of a bolt carrier assembly of a firearm from moving to its forward position so as to prevent the firearm from being discharged until the user manually moves the bolt catch. The bolt catch is mechanically coupled to the selector of the firearm via a linkage, so that the bolt catch can be moved by way of the selector. This feature can prevent a self-loading firearm that otherwise could function on a semi-automatic basis from operating in such a manner.

20 Claims, 10 Drawing Sheets

(56) References Cited

U.S. PATENT DOCUMENTS

| | | | | |
|---|---|---|---|---|
| 2018/0100714 | A1 | 4/2018 | Borders | |
| 2018/0172374 | A1 | 6/2018 | Lupher et al. | |
| 2018/0259282 | A1 | 9/2018 | Tolentino | |
| 2019/0072349 | A1* | 3/2019 | Verney-Carron ..... | F41A 17/78 |
| 2019/0093978 | A1 | 3/2019 | Maugham | |
| 2019/0137202 | A1 | 5/2019 | Facchini et al. | |
| 2020/0182575 | A1 | 6/2020 | Barrett et al. | |
| 2020/0292266 | A1 | 9/2020 | Underwood et al. | |

* cited by examiner

FIG. 12
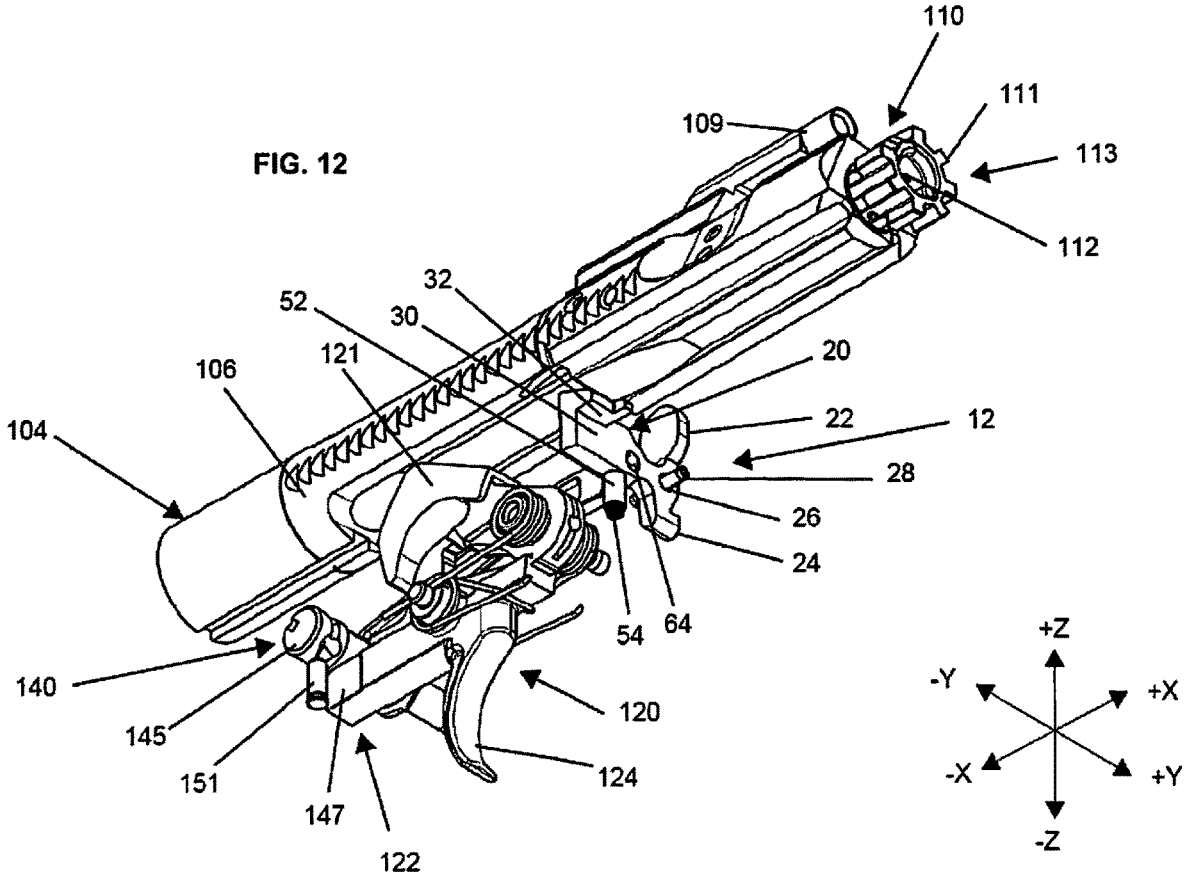
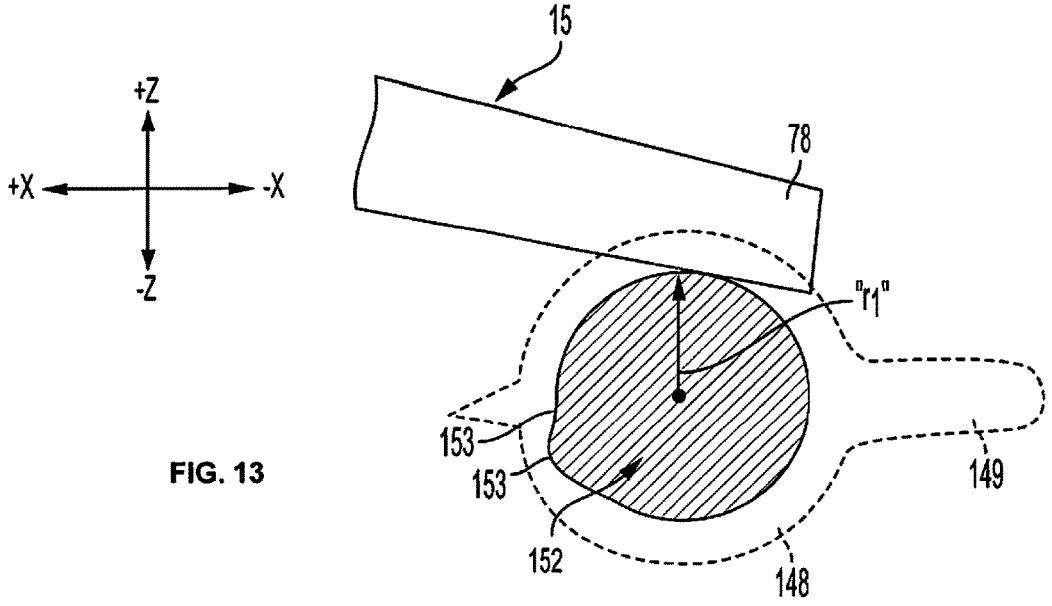
FIG. 13

LEVER-COUPLED DEVICE FOR SELECTIVELY PREVENTING A FIREARM FROM DISCHARGING

CROSS-REFERENCE TO RELATED APPLICATIONS

This application is a continuation of U.S. patent application Ser. No. 16/375,547 filed Apr. 4, 2019, the disclosure of which is hereby incorporated by reference in its entirety.

BACKGROUND

Semi-automatic firearms automatically eject a spent shell and chamber an unfired cartridge after each discharge of the firearm. Typically, this self-loading mechanism is actuated by high-pressure propellant gas generated during the discharge. In practice, after firing a semi-automatic weapon, the user must release the trigger bow so that the trigger mechanism resets before a newly loaded cartridge can be fired. The user can then reapply pressure to the trigger bow to actuate the trigger mechanism and fire the next round from the chamber. In this manner, only one cartridge can be fired with each pull of the trigger bow.

In some situations, it may be desirable for a firearm to have the self-loading capability of a semi-automatic firearm without the ability to repeatedly discharge the firearm by simply releasing and then reapplying pressure to the trigger bow. In such situations, an additional action by the user would be required for the trigger mechanism to reset such that the next round could be fired from the chamber. Thus, there is a need for a self-loading firearm that is prevented from firing unless and until the user takes an action to manipulate the firearm before the next pull of the trigger bow will cause the firearm to discharge the next round.

SUMMARY

In one aspect, the disclosed technology relates to a device for selectively preventing discharge of a firearm, the firearm including a bolt carrier assembly, the bolt carrier assembly having a bolt configured to move a cartridge into a chamber of the firearm, the device including: a bolt catch including a body, wherein the bolt catch is configured to be mounted on the firearm for movement in relation to the firearm between a first position and a second position at which the body is located at least partially within a path of travel of the bolt carrier assembly of the firearm so as to prevent the bolt from moving the cartridge into the chamber; and a lever mounted on the receiver for movement between a first and a second position, the lever including a first end coupled to the bolt catch, and a second end; wherein the lever is configured to move the bolt catch from the second to the first position of the bolt catch in response to movement of the lever from the second to the first position of the lever. In one embodiment, the second end of the lever is configured to contact a camming surface, and the lever is further configured to move from the second to the first position of the lever in response to movement of the camming surface in relation to the second end of the lever. In another embodiment, the camming surface is a surface of a selector of the firearm. In another embodiment, the bolt catch is further configured to be located outside of the path of travel of the bolt when the bolt catch is in the first position thereby permitting the bolt to move the cartridge into the chamber. In another embodiment, the body has a substantially flat major surface configured to engage a head of the bolt when the bolt catch is in the second position, and the engagement of the major surface and the bolt head prevents the bolt from moving the cartridge into the chamber of the firearm. In another embodiment, the bolt catch is configured to release the bolt when the bolt catch is moved from the second position to the first position of the bolt catch.

In another aspect, the disclosed technology relates to a firearm, including: a receiver; a bolt carrier assembly mounted on the receiver and including a bolt carrier and a bolt mounted at least partially within the bolt carrier; the bolt being configured to move in relation to the receiver between a rearward position, and a forward position at which the bolt secures a cartridge in a chamber of the firearm; a bolt catch including a body, wherein the bolt catch is configured to be mounted on the receiver for movement in relation to the receiver between a first position, and a second position at which the body prevents the movement of the bolt from the rearward position to the forward position so as to prevent discharge of the firearm; a selector mounted on the receiver and configured to move between a first position and a second position; and a linkage mounted on the receiver for movement between a first and a second position, the linkage including a first end coupled to the bolt catch, and a second end contacting the selector; wherein the selector is configured to move the linkage from the second to the first position of the linkage in response to movement of the selector from the first position to the second position of the selector; and the linkage is configured to move the bolt catch from the second position to the first position of the bolt catch in response to movement of the linkage from the second position to the first position of the linkage.

In one embodiment, the selector has a camming surface; the second end of the linkage is configured to contact the camming surface; and the camming surface is configured to move the linkage from the second to the first position of the linkage in response to the movement of the selector from the first position to the second position of the selector. In another embodiment, the selector includes a camming portion; the camming surface is located on the camming portion; and a distance between an axis of rotation of the selector and a point of contact between the second end of the linkage and the camming surface varies along a length of the camming surface. In another embodiment, the selector further includes a first end portion adjoining the camming portion; a central portion adjoining the camming portion; and a second end portion adjoining the central portion. In another embodiment, the firearm further includes a trigger mechanism mounted on the receiver and including a spring-biased hammer configured to strike the cartridge, and a trigger lever configured to move between a first position at which the trigger lever restrains the hammer against the spring bias on the hammer, and a second position; wherein: the selector is further configured to move between the first position of the selector and a third position; the central portion of the selector is configured to prevent movement of the trigger lever from the first position to the second position of the trigger lever only when the selector is in the third position of the selector. In another embodiment, the firearm further includes a pin secured to the first end of the linkage and configured to engage the body of the bolt catch by way of a slot formed in the body. In another embodiment, the linkage includes a lever. In another embodiment, the firearm further includes a biasing member configured to bias the bolt catch toward the second position of the bolt catch.

In another embodiment, the biasing member comprises a plunger including a housing, and coil spring configured to be positioned at least partially within the housing. In another embodiment, the bolt catch is further configured to be located outside of the path of travel of the bolt when the bolt catch is in the first position thereby permitting the bolt to move the cartridge into the chamber. In another embodiment, the bolt catch is further configured to rotate between the first and the second positions. In another embodiment, the body has a substantially flat major surface configured to engage a head of the bolt when the bolt catch is in the second position, and the engagement of the major surface and the bolt head prevents the bolt from moving the cartridge into the chamber of the firearm. In another embodiment, the bolt catch is configured to release the bolt when the bolt catch is moved from the second position to the first position of the bolt catch.

In another aspect, the disclosed technology relates to a firearm, including: a receiver; a bolt carrier assembly mounted on the receiver and including a bolt carrier and a bolt mounted at least partially within the bolt carrier; the bolt being configured to move in relation to the receiver between a rearward position, and a forward position at which the bolt secures a cartridge in a chamber of the firearm; a bolt catch including a body, wherein the bolt catch is configured to be mounted on the receiver for movement in relation to the receiver between a first position, and a second position at which the body prevents the movement of the bolt from the rearward position to the forward position of the bolt so as to prevent discharge of the firearm; a selector mounted on the receiver and configured to move between a first position and a second position, the selector including a camming surface; and a lever mounted on the receiver for movement between a first and a second position, the lever including a first end coupled to the bolt catch, and a second end contacting the camming surface; wherein a distance between an axis of rotation of the selector and a point of contact between the second end of the lever and the camming surface varies along a length of the camming surface so that the camming surface moves the lever from the second to the first position of the lever in response to movement of the selector from the first position to the second position of the selector; and the lever is configured to move the bolt catch from the second position to the first position of the bolt catch in response to movement of the lever from the second position to the first position of the lever.

BRIEF DESCRIPTION OF THE DRAWINGS

The following drawings are illustrative of particular embodiments of the present disclosure and do not limit the scope of the present disclosure. The drawings are not to scale and are intended for use in conjunction with the explanations in the following detailed description. Various non-limiting embodiments will be described in detail with reference to the drawings, wherein like reference numerals represent like parts and assemblies throughout the several views.

FIG. 12 is a right-bottom perspective view of the rifle shown in FIGS. 1-11, showing the bolt catch device in the depressed position and the safety selector in the release position.

FIG. 13 is a cross-sectional view of the safety selector, and a lever of the rifle shown in FIGS. 1-12, taken through the line "A-A" of FIG. 16, showing the safety selector in the safe position.

DETAILED DESCRIPTION

The present disclosure generally relates to a bolt catch device that prevents the bolt of a bolt carrier assembly of a firearm from moving to its forward position, thereby preventing discharge of the firearm, until the user manually moves the bolt catch. This feature can prevent a self-loading firearm that otherwise could function on a semi-automatic basis from operating in such a manner.

References to various embodiments and examples set forth in this specification do not limit the scope of the disclosure and merely set forth some of the many possible embodiments of the appended claims. Directional terms such as "upper," "lower," "above," "beneath," etc., unless otherwise noted, are used with reference to the component orientations depicted in the figures.

These terms are used for illustrative purposes only, and are not intended to limit the scope of the appended claims.

FIGS. 1-16 depict a bolt catch device 10, and various components thereof. The bolt catch device 10 is described herein in connection with a rifle 100. The bolt catch device 10 can be used in connection with other types of firearms, including handguns, pistols, other types of rifles, and the like. The bolt catch device 10 includes a bolt catch 12 that rotates between a first (depressed) position and a second (released) position. As explained in detail below, when in the released position, the bolt catch 12 prevents the rifle 100 from automatically chambering an unfired cartridge following discharge of the rifle 100, thereby preventing any subsequent discharge of the rifle 100. When manually moved to the depressed position, the bolt catch 12 allows the chambering process to proceed so that the rifle 100 can be readied for its next discharge.

Figure 1:
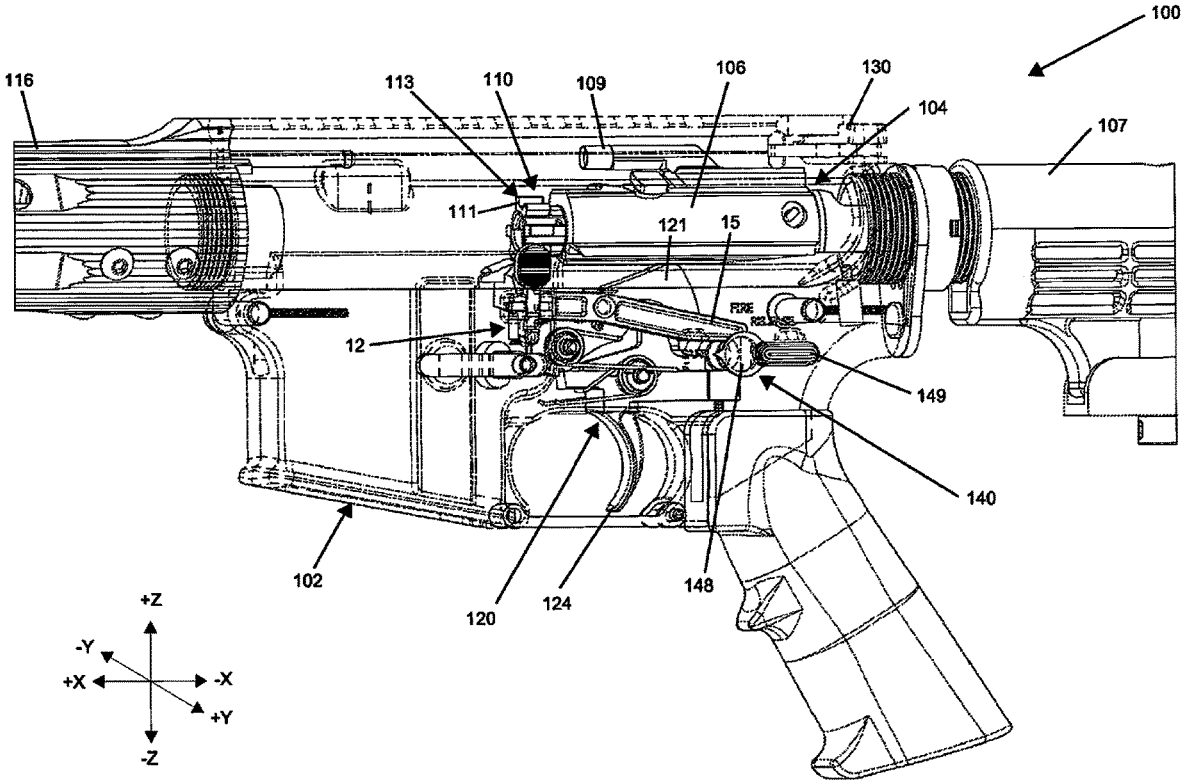
FIG. 1 is a left perspective view of a rifle having a bolt catch device that selectively prevents forward movement of a bolt and a bolt carrier of the rifle, showing the bolt catch device in a released position engaging the bolt and preventing forward movement of the bolt and the bolt carrier, and showing a safety selector of the rifle in a "safe" position.
Figure 4:
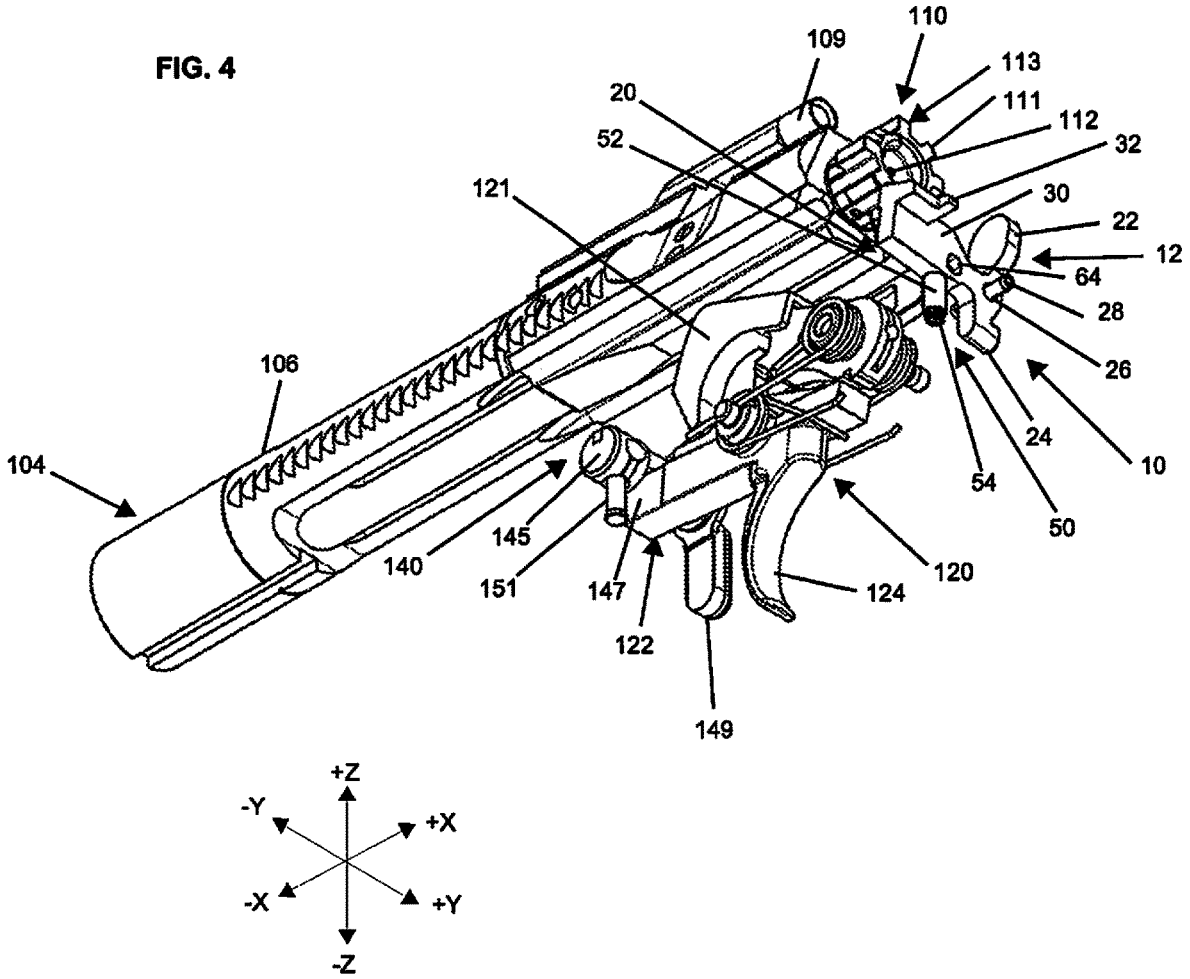
FIG. 4 is a right-bottom perspective view of the rifle shown in FIGS. 1-3, showing the bolt catch in the released position and the safety selector in the safe position.
Figure 5:
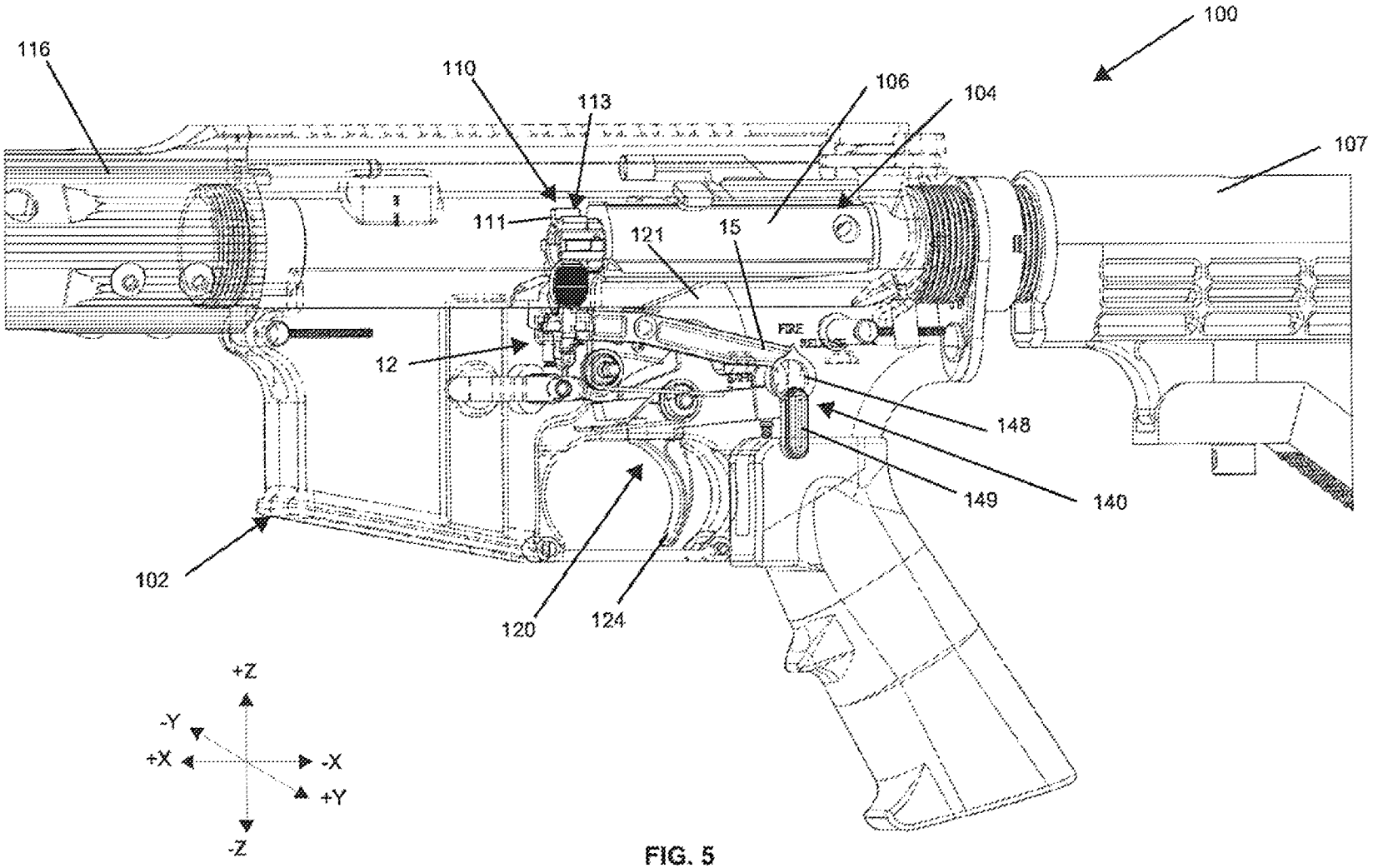
FIG. 5 is a left perspective view of the rifle shown in FIGS. 1-4, showing the bolt catch device in the released position and the safety selector in a "fire" position.
Figure 8:
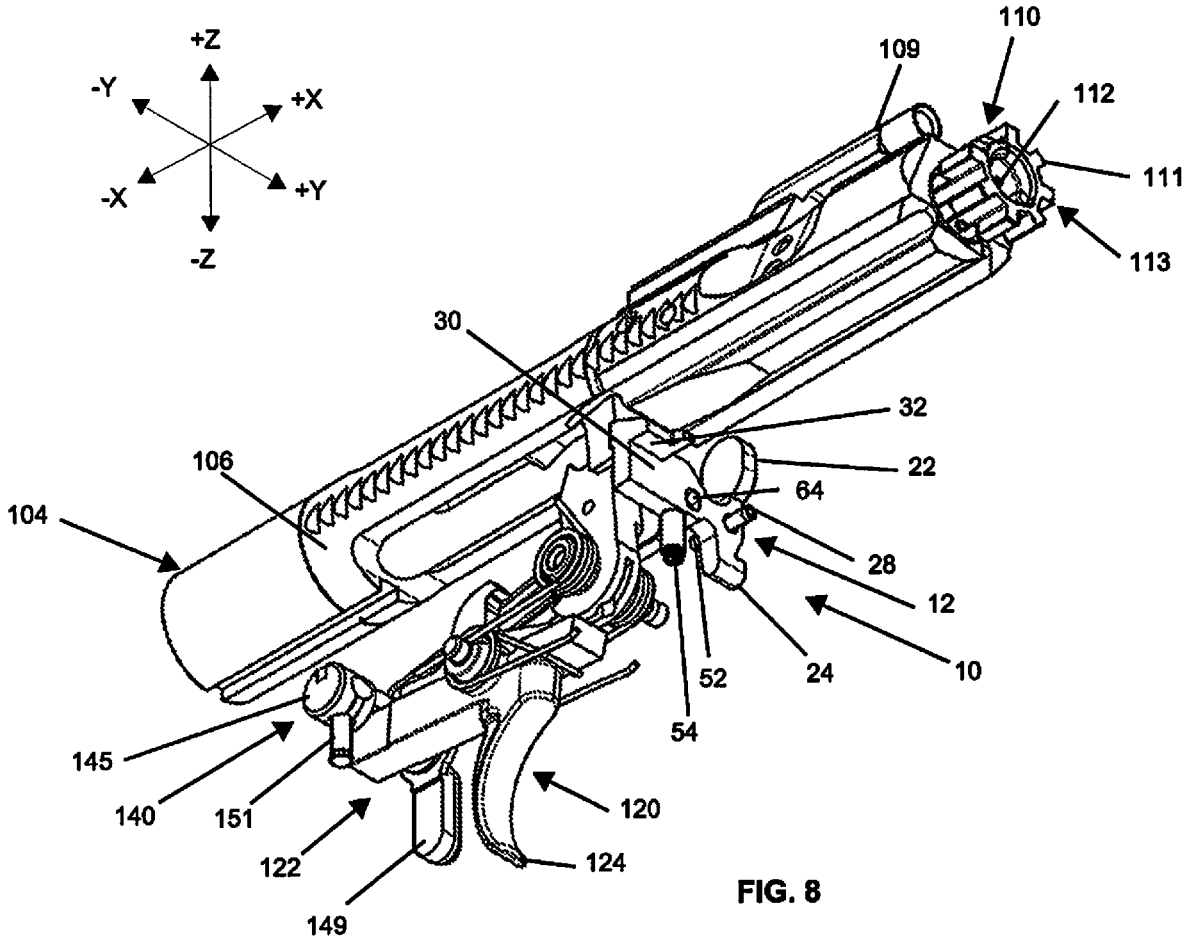
FIG. 8 is a right-bottom perspective view of the rifle shown in FIGS. 1-7, showing the bolt catch device in the released position and the safety selector in the fire position.
Figure 9:
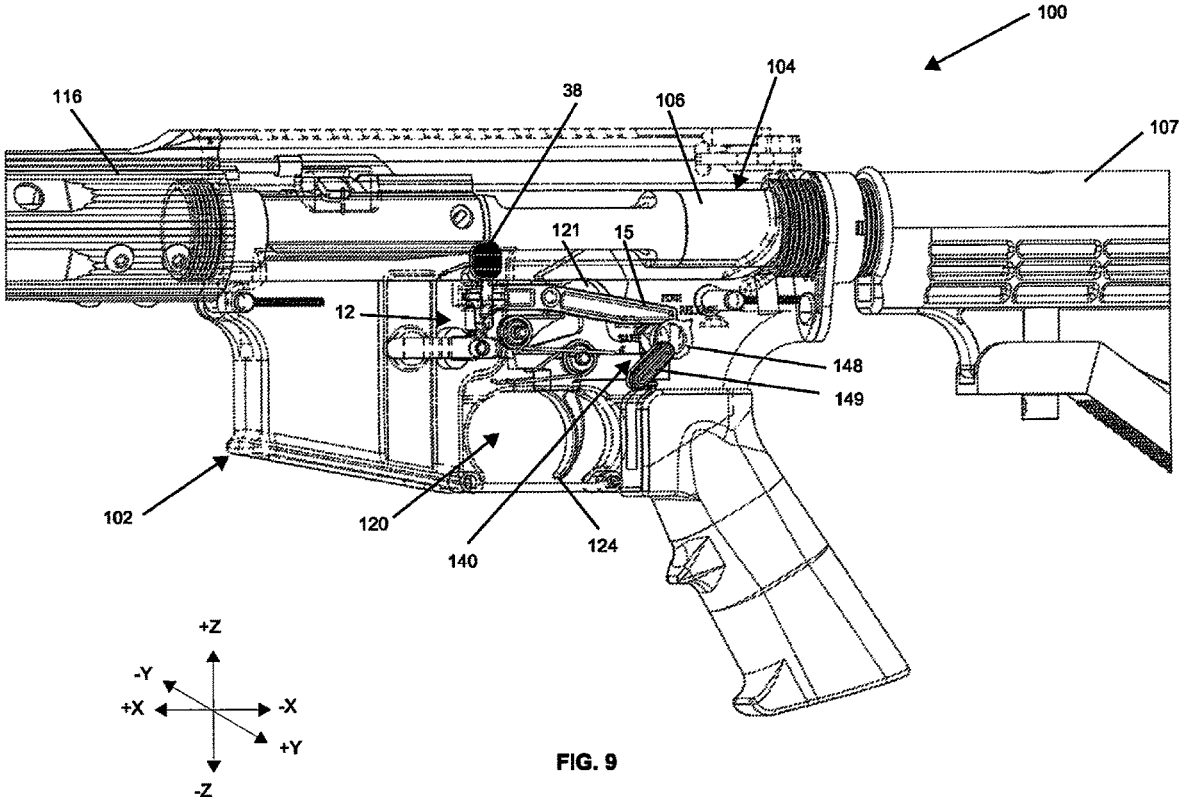
FIG. 9 is a left perspective view of the rifle shown in FIGS. 1-8, showing the bolt catch device in a depressed position after releasing the bolt and the bolt carrier; and showing the safety selector in a "release" position.

Referring to FIGS. 1, 5, and 9, the rifle 100 comprises a receiver 102 and a bolt carrier assembly 104. The receiver 102 is mounted on a stock 107 of the rifle 100. The bolt carrier assembly 104 includes a bolt carrier 106, a bolt 110, and a firing pin 112. The firing pin 112 is visible, in part, in FIGS. 3, 4, 7, 8, 11, and 12. The bolt carrier 106 defines a bolt chamber (not shown). A rearward portion of the bolt 110 is positioned within the bolt chamber, and can move both linearly and rotationally within the bolt chamber. The rear portion of the bolt 110 has gas seal rings (also not shown) that form a movable seal between the bolt 110 and the adjacent surface of the bolt carrier 106.

The firing pin 112 extends through a bore formed in the bolt 110, and is configured to translate linearly in relation to the bolt 110. The bolt carrier 106 is positioned on two guide rails that permit the bolt carrier assembly 104 to translate linearly, in the "x" direction, in relation to the receiver 102. The bolt carrier 106 is biased in the forward ("+x") direction, by a buffer spring (not shown).

Referring to FIGS. 2, 4, 6, 8, 10, and 12, the rifle 100 also includes a trigger mechanism 120. The trigger mechanism 120 comprises a spring-loaded hammer 121, and a trigger lever 122.

Figure 6:
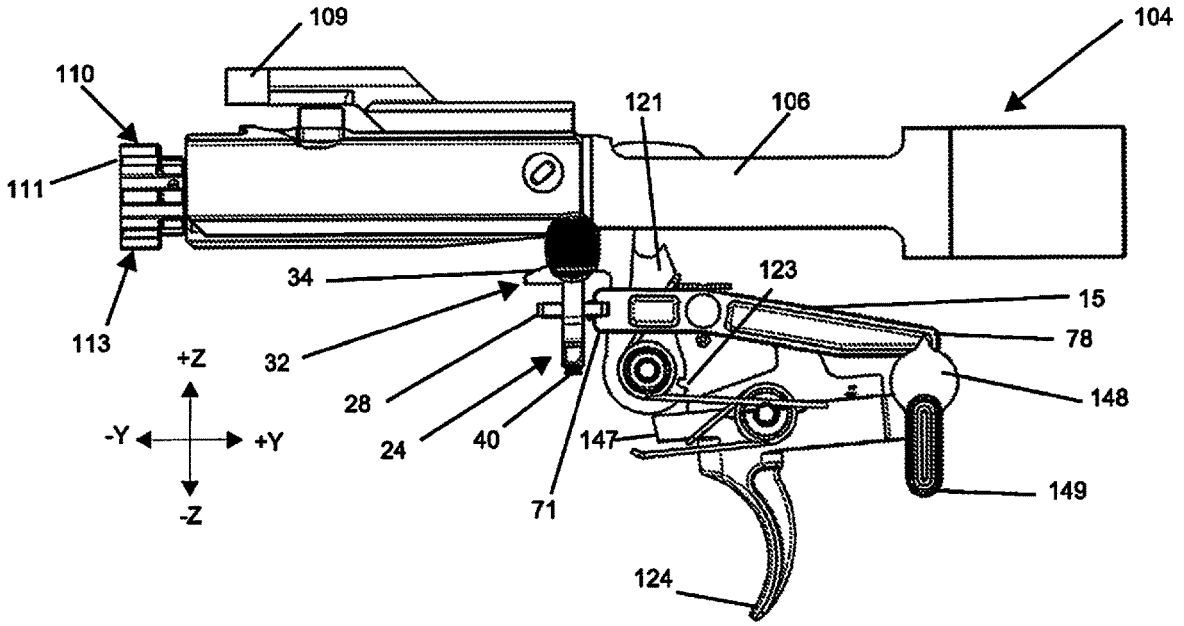
FIG. 6 is a left side view of the rifle shown in FIGS. 1-5, showing the bolt catch device in the released position and the safety selector in the fire position.

The hammer 121 is configured to strike a rearward end of the firing pin 112. Prior to initiation of the firing sequence, the hammer 121 is held against its spring bias in a pre-firing position, depicted in FIGS. 10 and 12, at which the striking surface of the hammer 121 is spaced apart from the firing pin 112. The hammer 121 is restrained by the trigger lever 122, which engages the hammer 121 via a notch 123 formed in the hammer 121. Pulling a trigger bow 124 of the trigger lever 122 causes the trigger lever 122 to rotate in counterclockwise direction, from the perspective of FIGS. 2, 6, and 10, which in turn causes the trigger lever 122 to disengage from, and release the hammer 121. Once released, the hammer 121 rotates in a counterclockwise direction, from the perspective of FIGS. 2, 6, and 10, and strikes the rearward end of the firing pin 112 as shown in FIG. 6.

The receiver 102 has a chamber (not shown) that receives an unfired cartridge. The firing sequence for the rifle 100 is initiated when the user pulls the trigger bow 124, thereby releasing the hammer 121. The hammer 121, rotating under its spring bias, strikes a rearward end of the firing pin 112. The firing pin 112 transfers the impact from the hammer 121 to the rearward end of the cartridge, igniting an impact-sensitive primer in the cartridge. The primer ignites a propellant within the cartridge. The expanding propellant gas propels a projectile of the cartridge out of the chamber, and into and through a bore (not shown) formed in a barrel 116 of the rifle 100. The projectile subsequently exits the open end (muzzle) of the barrel 116.

The trigger mechanism 120 also includes a selector in the form of a safety selector 140. The safety selector 140 is mounted for rotation on the receiver 102. The safety selector 140 can be moved between a "release" position shown in FIGS. 9-12; a "fire" position shown in FIGS. 5-8;

and a "safe" position shown in FIGS. 1-4. When in the safe position, the safety selector 140 prevents the trigger lever 122 from rotating. This prevents the trigger lever 122 from releasing the hammer 121, thereby preventing discharge of the rifle 100. When in the release position, the safety selector 140 causes the bolt catch 12 to move to its released position, as discussed in detail below. When in the fire position, the safety selector 140 does not interfere with or otherwise prevent the trigger lever 122 from rotating, and the rifle 100 can be discharged when the user pulls the trigger bow 124, provided the bolt catch 12 had been moved to its release position following the previous discharge of the rifle 100.

Figure 16:
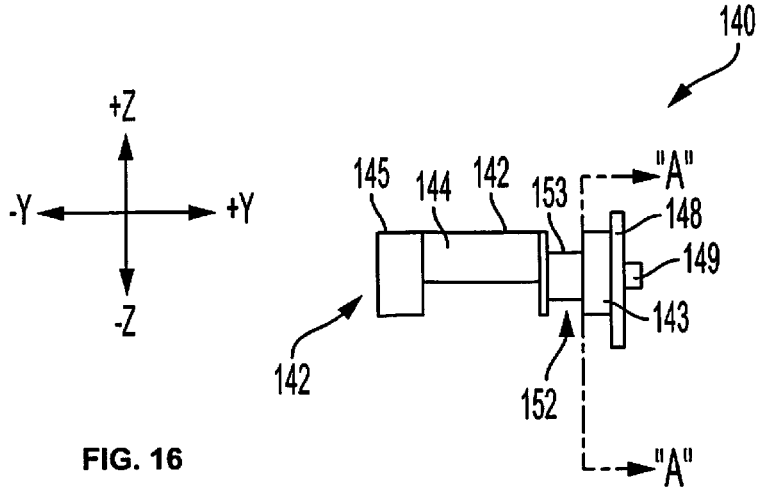
FIG. 16 is a front view of the safety selector shown in FIGS. 13-15, showing the safety selector in the safe position.

As shown in FIG. 16, the safety selector 140 includes a body 142 having a first end portion 143; a camming portion 152 adjoining the first end portion 143; a central portion 144 adjoining the camming portion 152; and a second end portion 145 adjoining the central portion 144. The body 142 is located inside of the receiver 102. The safety selector 140 also includes a tab 148 that adjoins the camming portion 152; and an arm 149 that adjoins the tab 148. The tab 148 and the arm 149 are located outside of the receiver 102. As shown in FIGS. 1, 5, and 9, the tab 148 has a pointer that, in conjunction with corresponding markings on the receiver 102, provides a visual indication of position of the safety selector 140. The arm 149 can be grasped or pushed by the user to move the safety selector 140 between the safe, fire, and release positions.

The first and second end portions 143, 145 are substantially cylindrical, and are positioned partially in respective apertures formed in the receiver 102. The central portion 144 is configured as a half cylinder, and is located directly above a rearward end 147 of the trigger lever 122 when the safety selector 140 is in the safe position shown in FIGS. 1-4. The resulting interference between the central portion 144 and the rearward end 147 prevents the trigger lever 122 from rotating in the counterclockwise direction, from the perspective of FIG. 2, which in turn prevents the rifle 100 from discharging.

The safety selector 140 is depicted in fire position in FIGS. 5-8. The safety selector 140 rotates clockwise, from the perspective of FIGS. 5 and 6, by approximately 90 degrees when the safety selector 140 is moved from the safe position to the fire position. This movement causes the central portion 144 of the safety selector 140 to move out of a position directly above the rearward end 147 of the trigger lever 122. Thus, the safety selector 140 no longer interferes with rotation of the trigger lever 122, and the rifle 100 can be discharge when the trigger bow 124 is pulled, provided the bolt catch 12 had been moved to its release position following the previous discharge of the rifle 100.

Figure 10:
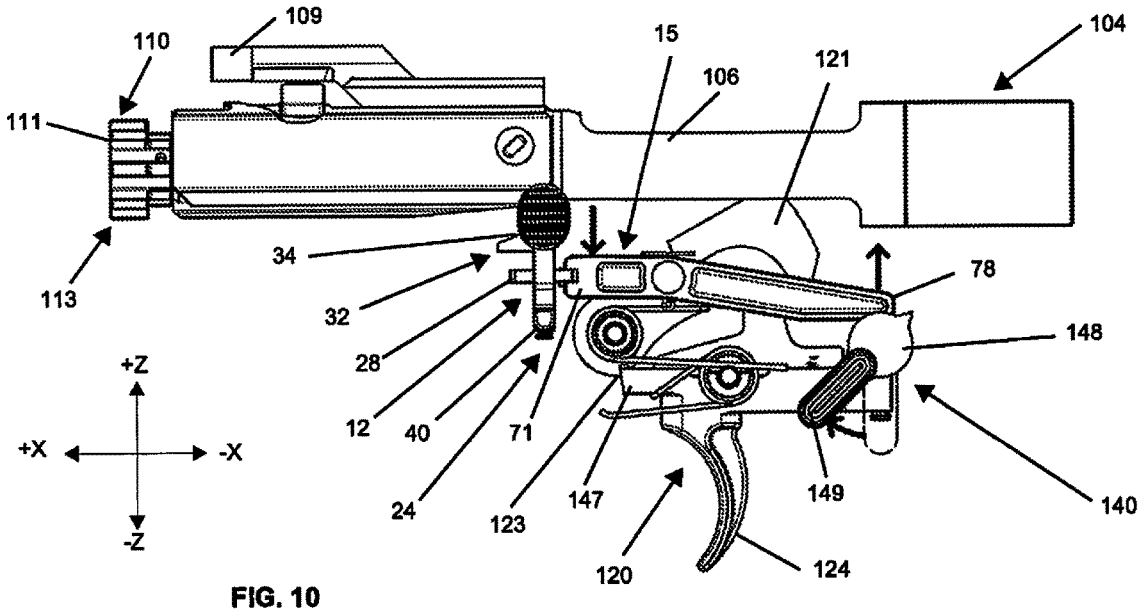
FIG. 10 is a left side view of the rifle shown in FIGS. 1-9, showing the bolt catch device in the depressed position and the safety selector in the release position.

As shown in FIGS. 6 and 10, the safety selector 140 rotates clockwise when moved from the fire position to the release position by, for example, about 30 degrees to about 60 degrees, such as about 40 degrees to about 50 degrees, or about 45 degrees. As discussed in detail below, moving the safety selector 140 to the release position moves the bolt catch 12 from its released position to its depressed position, allowing the chambering process to proceed so that the rifle 100 can be readied for its next discharge.

The safety selector 140 is retained in the fire and safe positions by a spring-loaded detent 151, shown in FIGS. 4, 8, and 12, that engages recesses formed in the second end portion 145 of the safety selector 140. The safety selector 140 will return to the fire position from the release position under the below-described spring bias of the bolt catch 12, once the user releases the arm 149 after moving the safety selector 140 to the release position.

A portion of the high-pressure propellant gas in the bore is directed to the bolt carrier assembly 104. In particular, the propellant gas is directed to a gas key 109 on the bolt carrier 106, by way of a gas tube (not shown) having an internal passage that adjoins the bore. From the gas key 109, the propellant gas enters a gas actuation chamber (also not shown) formed by a volume between an internal wall of the bolt carrier 106 and the rear portion of the bolt 110.

The bolt carrier 106 moves rearward, in a linear ("−x") direction, within the receiver 102 in response to the pressure exerted by the propellant gas G within the gas actuation chamber. In addition, the bolt 110 is driven forward within the bolt chamber by the pressure of the propellant gas G acting on the interior surface of the bolt carrier 106 and the gas seal rings of the bolt 110. The bolt carrier 106 compresses a buffer spring (not shown) as the bolt carrier 106 translates rearward. The buffer spring eventually drives the bolt carrier 106 and the bolt 110 forward when the pressure exerted by the propellant gas G has decreased sufficiently so as to be overcome by the force of the buffer spring.

As the bolt carrier 106 is initially retracted rearward under the pressure of the propellant gas G and the bolt 110 is driven forward in relation to the bolt carrier 106, the bolt 110 is rotated sufficiently to unlock its head 113 from a barrel extension (not shown). The bolt 110 then retracts in the "−x" direction along with the bolt carrier 106. As the bolt 110 retracts, the spent case of the cartridge is extracted from the chamber by an extractor located on the bolt 110. The spent case is then ejected through an ejection port formed in the stock 107. As the bolt carrier 106 and bolt 110 are subsequently driven forward by the buffer spring, an unfired cartridge is fed into position in front of the bolt 110 from a spring-loaded magazine (not shown). The cartridge is then pushed into the chamber by the forwardly-advancing bolt 110. As the bolt 110 reaches its forward-most position, the bolt 110 rotates so that the bolt head 113 re-engages the barrel extension, thereby locking the bolt 110 in place.

As the bolt carrier 106 is driven rearward by the propellant gas, the hammer 121 of the trigger mechanism 120 is rotated into a cocked position, depicted in FIGS. 9-12, by a cocking piece located on the rearward end of the bolt carrier 106. The hammer 121 is held in its cocked position until the next firing sequence is initiated by the user.

The above details of the rifle 100 are presented for illustrative purposes only. The bolt catch device 10 can be used in connection with firearms having structural and operational characteristics other than those described above, including firearms equipped with gas-piston bolt carrier assemblies.

The bolt catch device 10 interrupts the movement of the bolt 110 as the bolt 110 and the bolt carrier 106 begin to move forward, after having been driven rearward by the high-pressure propellant gas. The bolt catch device 10 restrains the bolt 110 and the bolt carrier 106 against the forward bias of the buffer spring, thereby preventing the bolt 110 from moving an unfired cartridge into the chamber, until the user manually actuates the bolt catch device 10. The bolt catch device 10 thus prevents the rifle 100 from functioning on semi-automatic basis, i.e., from being repeatedly discharged with no action on the part of the user other than relaxing and then reapplying pressure on the trigger 120.

Referring to FIGS. 2-4, 6-8, and 10-12, the bolt catch device 10 includes a bolt catch 12; a biasing member in the form of a plunger 50; and a linkage in the form of a lever 15. The bolt catch 12 is mounted for rotation on a pin 28.

The bolt catch 12 is movable between a depressed position shown in FIGS. 9-12; and a released position shown in FIGS. 1-8. The plunger 50 exerts a clockwise bias on the bolt catch 12, from the perspective of FIGS. 3, 7, and 11. This bias urges the bolt catch 12 toward its released position. When in the released position, the bolt catch 12 interferes with, and prevents forward movement of the bolt 110, thereby preventing the firearm 100 from being discharged. When in the depressed position, the bolt catch 12 does not interfere with or otherwise prevent forward movement of the bolt 110, and the bolt 110 and the bolt carrier 106 are free to move to their respective forward positions under the bias of the buffer spring, thereby placing the firearm 100 in a condition to be discharged. Because the bolt 110 and the bolt carrier 106 are prevented from moving to their forward positions until the user manually rotates the bolt catch 12 to the depressed position, the rifle 100 cannot operate on a semi-automatic basis, i.e., the rifle cannot be repeatedly discharged by simply releasing and then reapplying pressure to the trigger bow—additional action by the user is required.

As can best be seen in FIGS. 3, 4, 7, 8, 11, and 13, the bolt catch 12 includes a body 20; a tab 22 that adjoins the body 20; and a stop 24 that adjoins the body 20 and the tab 22. The body 20 has a hole 26 formed therein. The hole 26 receives the pin 28. The ends of the pin 28 are secured to the receiver 102. The pin 28 is sized to fit within the hole 26 with minimal clearance, so that the bolt catch 12 can rotate in relation to the pin 28 and the receiver 102.

Figure 2:
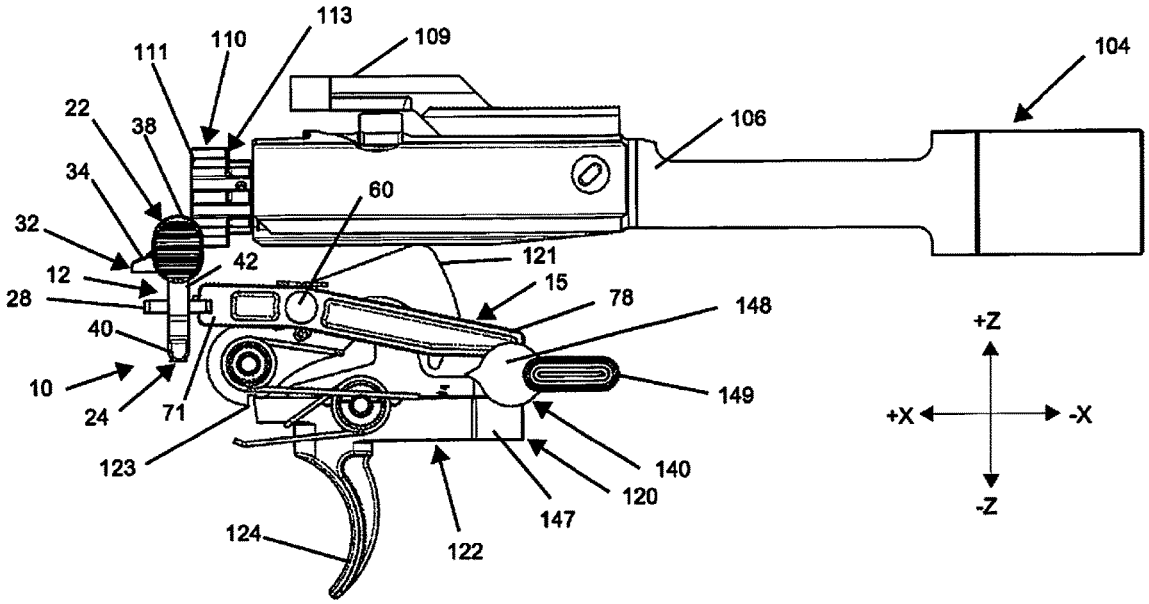
FIG. 2 is a left side view of the rifle shown in FIG. 1, showing the bolt catch device in the released position and the safety selector in the safe position.

The body 20 is positioned within the receiver 102, and is located below the bolt carrier 106 when the bolt carrier 106 is in its forward position, as shown in FIGS. 10 and 12. The body 20 incudes a main portion 30 and a ledge 32. The ledge 32 adjoins an upper end of the main portion 30, and extends forward from the main portion 30 as shown in FIGS. 4, 8, and 12. An upper surface 34 of the ledge 32 is downwardly angled in the forward ("+x") direction, as shown in FIGS. 2, 6, and 10. This feature helps to ensure that the bolt carrier 106 can freely move rearward in relation to the bolt catch 12 as the bolt carrier 106 is driven rearward by the propellant gas.

The tab 22 adjoins the main portion 30 of the body 20, and extends out of the receiver 102 through an opening in the receiver 102. The tab 22 has a major surface 38 that is located outside of the receiver 102, and faces outward, i.e., away from the receiver 102. The major surface 38 can be seen, for example, in FIGS. 2, 6, and 10. The stop 24 has an outwardly-facing surface 40 that contacts an inwardly-facing surface of the receiver 102 when the bolt catch 12 reaches its depressed position, thereby stopping the counterclockwise rotation of the bolt catch 12. The surface 40 visible, for example, in FIGS. 2, 6, and 10.

The main portion 30 of the body 20 has a rearward-facing surface 42, denoted in FIGS. 2, 6, and 10. The bolt catch 12 is configured so that a portion of the surface 42 is in the path of travel of the bolt 110 when the bolt catch 12 is in its released position. The surface 42 aligns with, and contacts a forward surface 111 of the bolt head 113 when the bolt 110 moves forward from its rearward position and the bolt catch 12 is in the released position. As shown in FIGS. 2-4 and 6-8, the resulting interference between the bolt catch 12 and the bolt 110 prevents further forward movement of the bolt 110 and the bolt carrier 106, as long as the bolt catch 12 remains in its released position. This in turn prevents the chambering of an unfired cartridge and the release of the hammer 121, thereby preventing the rifle 100 from being discharged.

Figure 3:
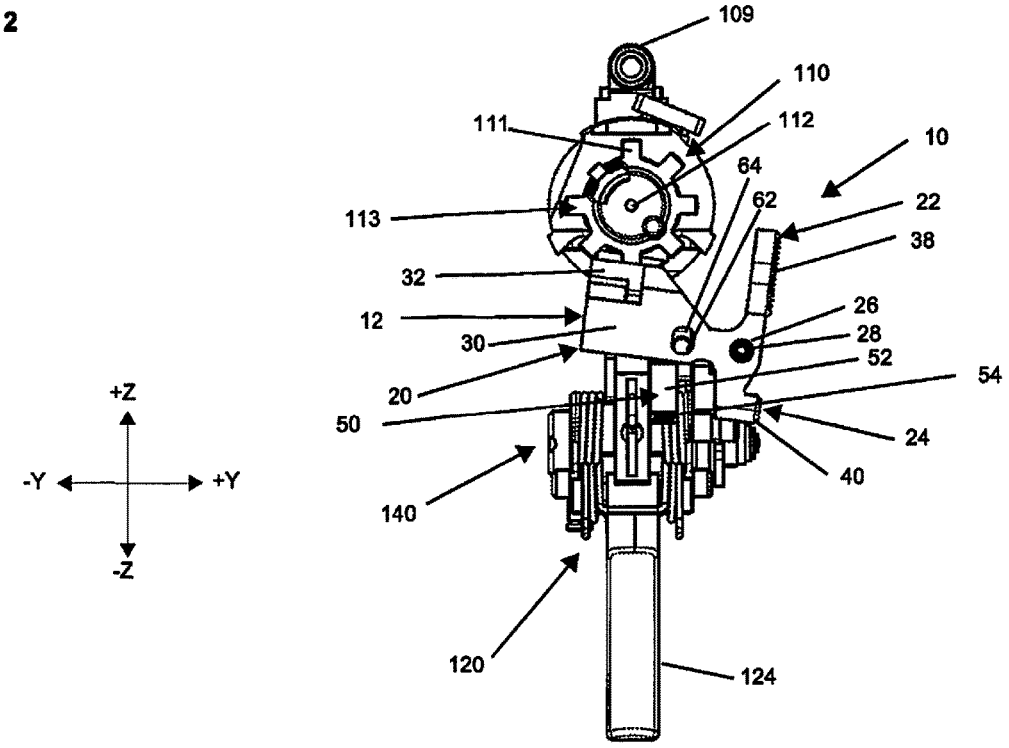
FIG. 3 is a front view of the rifle shown in FIGS. 1 and 2, showing the bolt catch device in the released position and the safety selector in the safe position.
Figure 7:
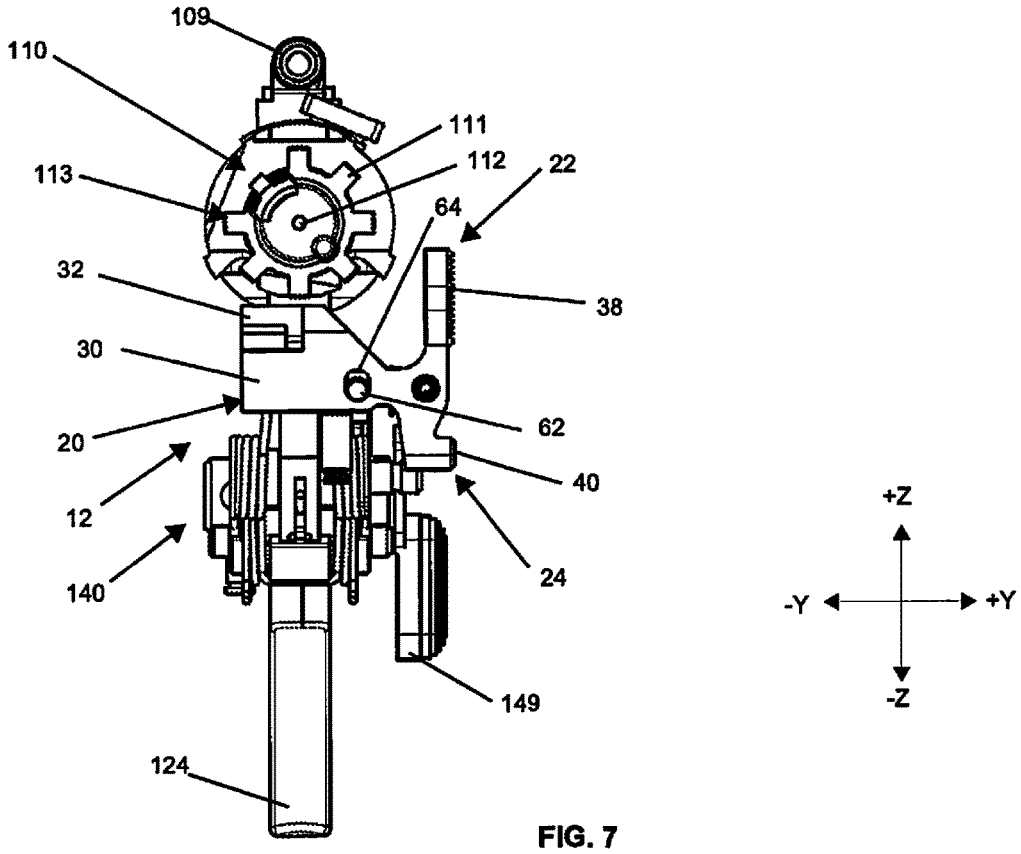
FIG. 7 is a front view of the rifle shown in FIGS. 1-6, showing the bolt catch device in the released position and the safety selector in the fire position.
Figure 11:
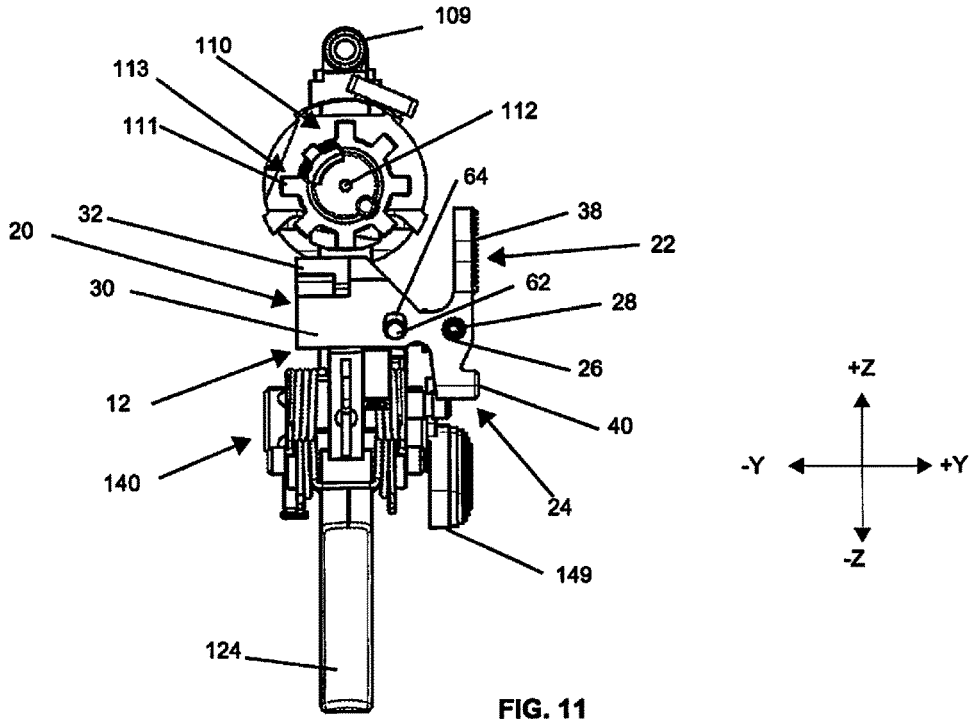
FIG. 11 is a front view of the rifle shown in FIGS. 1-10, showing the bolt catch device in the depressed position and the safety selector in the release position.

As shown in FIGS. 3, 7, and 11, the plunger 50 includes a cylindrical casing 52, and a coil spring 54 housed, in part, within the casing 52. An upper end of the casing 52 is closed;

a lower end of the casing 52 is open. The plunger 50 is positioned within a bore (not shown) formed in the receiver 102 and located directly below the main portion 30 of the body 20 of the bolt catch 12, so that the closed upper end of the casing 52 contacts, and is biased against, a lower surface of the main portion 30. The diameter of the bore is sized so that the casing 52 fits within the bore with minimal clearance, and can move up and down within the bore as the bolt catch 12 moves between its released and depressed positions. A torsion spring can be used in lieu of the plunger 50 in alternative embodiments.

The lever 15 is mounted for rotation on a pin 60, as shown in FIGS. 2, 6, and 10. The pin 60 is secured to the receiver 102, so that the lever 15 can rotate in relation to the receiver 102.

A pin 62 is secured to a first (e.g., forward) end 71 of the lever 15. The main portion 30 of the body 20 of the bolt catch 12 has a slot 64 formed therein. The slot 64 receives the pin 62. The pin 62 and the slot 64 are visible in FIGS. 3, 7, and 11. As used herein, a "pin" (e.g., pin 28, pin 60, pin 62, etc.) refers to a round pin, screw, square pin, flat pin, solid cylindrical pin, tapered pin, groove pin, spring pin, or any other shaped component or structure that would serve the relevant purpose described herein.

Figure 14:
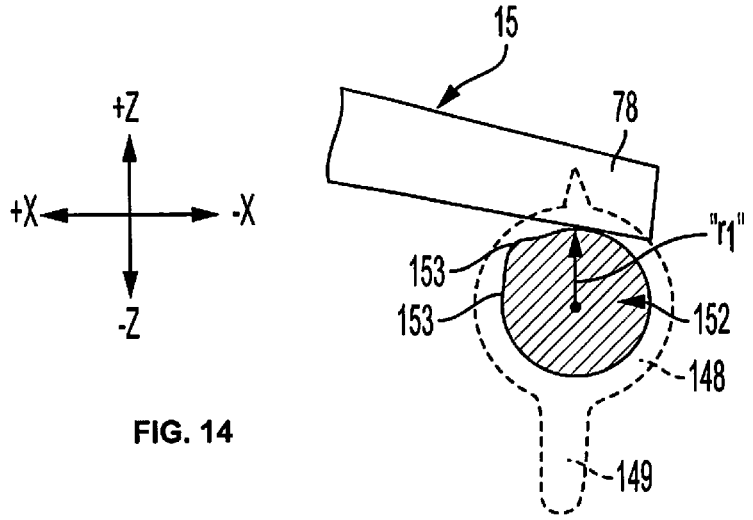
FIG. 14 is a cross-sectional view of the safety selector and the lever shown in FIG. 13, taken through the line "A-A" of FIG. 16, showing the safety selector in the fire position.
Figure 15:
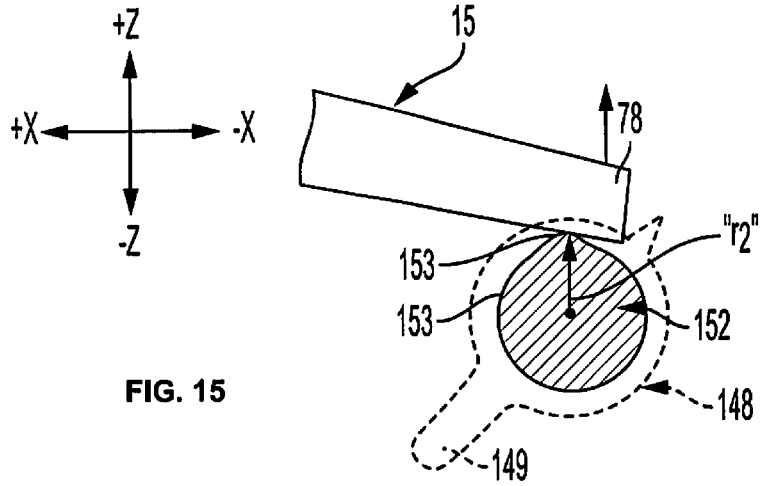
FIG. 15 is a cross-sectional view of the safety selector and the lever shown in FIGS. 13 and 14, taken through the line "A-A" of FIG. 16, showing the safety selector in the release position.

A second (e.g., rearward) end 78 of the lever 15 engages a camming surface 153 on the camming portion 152 of the safety selector 140, as shown in FIGS. 13-15. The rearward end 78 is biased toward a the camming surface 153 by the bolt catch 12, which as noted above is biased toward its released position by the plunger 50. The camming surface 153 is configured so that rotation of the safety selector 140 to the release position causes the lever 15 and the attached pin 62 to rotate in relation to the receiver 102 in a counter-clockwise direction, from the perspective of FIGS. 1, 5, 9, and 13-15. In particular, as shown in FIGS. 13-15, the distance (e.g., radius) between the camming surface 153 and the axis of rotation of the safety selector 140 varies along the camming surface 153 between a minimum value "$r_1$" and a maximum value "$r_2$." The distance between an axis of rotation of the safety selector 140 and a point of contact between the second end of the linkage and the camming surface thus varies along a length of the camming surface 153.

The safety selector 140 is configured so that the portion of the camming surface 153 corresponding to the minimum radius $r_1$ contacts the rearward end 78 of the lever 15 when the safety selector 140 is in the safe and fire positions, depicted respectively in FIGS. 13 and 14. The safety selector 140 is further configured so that the portion of the camming surface 153 corresponding to the maximum radius $r_2$ contacts the rearward end 78 of the lever 15 when the safety selector 140 is in the release position, shown in FIG. 15. The resulting change in height of the point of contact between the rearward end 78 of the lever 15 and the camming surface 153 causes the rearward end 78 to rise, as denoted by the arrow in FIG. 15, as the safety selector 140 rotates from the fire position to the release position.

Because the rearward end 78 and the forward end 71 of the lever 15 are located on opposite sides of the rotational axis of the lever 15, the upward movement of the rearward end 78 causes the forward end 71 of the lever 15 to move downward. This can be seen, for example, in FIGS. 6 and 10, with the movement of the lever 15 denoted by arrows in FIG. 10. The downward movement of the forward end 71 imparts a corresponding downward movement to the attached pin 62. The downward movement of the pin 62, which engages main portion 30 of the bolt catch 12 by way of the slot 64, causes the main portion 30 to move generally downward. The downward movement of the main portion 30 imparts a counter-clockwise rotation to the bolt catch 12 and causes the bolt catch 12 to move from the released position to the depressed position.

The shape of the camming surface 153 can vary from that depicted herein. For example, the camming surface 153 of alternative embodiments can have a portion configured as a flat ramp, or other suitable geometric features, that lift the rearward end 78 of the lever 15 as the safety selector 140 is moved to the release position.

The user also can move the bolt catch 12 from the released to the depressed position by pressing inwardly, i.e., toward the receiver 102, on the major surface 38 of the tab 22. Alternative embodiments can be equipped with a bolt catch that does not include the tab 22. In such embodiments, moving the safety selector 140 to the release position is the sole way of releasing the bolt 110 from the bolt catch. The structure and operation of such alternative embodiments otherwise can be substantially identical to those of the bolt catch device 10.

As shown in FIGS. 9-12, the body 20 of the bolt catch 12 moves out of alignment with, and out of the path of travel of the bolt 110 and the bolt carrier 106 when the bolt catch 12 rotates to its released position in response to the movement of the safety selector 140 to its release position. Thus, when the user moves the safety selector 140 to its release position, the bolt catch 12 no longer restrains the bolt carrier 106 and the bolt 110 from forward movement, and the bolt 110 and the bolt carrier 106 move forward under the bias of the buffer spring.

The advancing bolt 110 pushes an unfired cartridge into the chamber, and the bolt 110 subsequently engages the barrel extension. Also, the bolt carrier 106, after advancing to its forward position, no longer interferes with movement of the hammer 121. Thus, the rifle 100 at this point is ready to fire again.

Upon release of the safety selector 140 or the tab 22 by the user after the bolt 110 has advanced to its forward position, an upper surface of the body 20 is urged into contact with the underside of the bolt carrier 106 by the bias of the plunger 50. As noted above, the body 20 is configured so that the bolt catch 12 does not interfere with the rearward movement of the bolt carrier 106 or the bolt 110 as these components move rearward following discharge of the rifle 100.

The bolt catch 12 of alternative embodiments can be configured to contact the bolt carrier 106, instead of the bolt 110, when the bolt catch 12 is in its released position. In such embodiments, the bolt 110 will still be prevented moving forward to re-chamber a new cartridge when the bolt catch 12 is in the released position, but the forward movement of the bolt 110 will be prevented by interference between the bolt catch 12 and the bolt carrier 106, instead of direct contact between the bolt 110 and the bolt catch 12.

In other alternative embodiments, the selector is not configured to perform the safety interlock function of the safety selector 140. In such embodiments, the sole function of the selector is to move the lever 15 (or other type of linkage) between the first and second positions of the lever 15, in a manner similar to the safety selector 140.

The firing sequence for the rifle 100 can proceed as follows. After the user has inserted a loaded magazine into the rifle 100, the user can pull a charging handle 130 of the rifle 100 to move the bolt carrier 106 and the bolt 110 rearward. As the bolt carrier 106 and the bolt 110 are drawn rearward, an unfired cartridge is fed from the new magazine into position in front of the bolt 110. The charging handle 130 is pushed forward by the user after the bolt carrier 106 and the bolt 110 have reached their rearward positions. This allows the bolt carrier 106 and the bolt 110 to move forward under the bias of the buffer spring. The bolt carrier 106 and the bolt 110 continue to move forward until the forward surface 111 of the bolt 110 contacts the surface 42 of the bolt catch 12, which is in its released position shown in FIGS. 1-8. As discussed above, the resulting interference between the body 20 of the bolt catch 12 and the head 113 of the bolt 110 prevents further forward movement of the bolt 110 and the bolt carrier 106 and thereby prevents the firearm 100 from being discharged.

The user continues to move the charging handle 130 forward, until the charging handle 130 reaches its forward most (stowed) position. Once the charging handle 130 is stowed, the user can rotate the safety selector to the release position. Alternatively, the user can push inwardly on the major surface 38 of the tab 22 of the bolt catch 12, to rotate the bolt catch 12 to its depressed position. At this point, the bolt 110 and the bolt carrier 106 are released from the bolt catch 12 and move forward to the respective positions depicted in FIGS. 9-12, resulting in the chambering of an unfired cartridge and otherwise placing the rifle 100 in a condition for firing.

As the rifle 100 is subsequently fired, the bolt carrier 106 and the bolt 110 are driven rearward by the high-pressure propellant gas from the fired cartridge as explained above. The spent casing is ejected from the rifle by the ejector, and the bolt carrier 106 and the bolt 110 begin to move forward once the force exerted by the propellant gas has dissipated to a level where it is overcome by the bias of the buffer spring. The forward movement of the bolt 110 and the bolt carrier 106 is interrupted by the bolt catch 12 in the above-discussed manner, thereby preventing the rifle 100 from being readied to be fired again.

The rifle 100 will remain in a state at which it cannot be fired, until the user causes the bolt catch 12 to move to its depressed position by rotating the safety selector 140 to the release position, or by pushing inwardly on the major surface 38 of the tab 22 of the bolt catch 12. Moving of the bolt catch 12 to its released position will release the bolt 110 and the bolt carrier 106 from the bolt catch 12, thereby permitting the bolt 110 and the bolt carrier 106 to complete their forward travel to place the rifle 100 in a condition to be fired. Thus, because the rifle 100 cannot be re-fired unless and until the user takes the positive action of manually releasing the bolt 110 from the bolt catch 12, the rifle 100 cannot be operated on a semi-automatic basis.

The body 20 of the bolt catch 12 can have a width ("y" dimension) of about 0.7 inch to about 1.0 inch, such as about 0.80 inch to about 0.95 inch; a height ("z" dimension) of about 0.3 inch to about 0.7 inch, such as about 0.45 inch to about 0.625 inch; and a thickness ("x" dimension) of about 0.1 inch to about 0.4 inch, such as about 0.125 inch to about 0.375 inch. The tab 22 can have a width ("x" dimension) of about 0.2 inch to about 1.2 inch, such as about 0.375 inch to about 1 inch; a height ("z" dimension) of about 0.2 inch to about 0.7 inch, such as about 0.375 inch to about 0.625 inch; and a thickness ("y" dimension) of about 0.1 inch to about 0.4 inch, such as about 0.13 inch to about 0.375 inch. The lever 15 can have a length ("x" dimension) of about 2.1 inch to about 2.8 inch, such as about 2.25 inch to about 2.75 inch; a height ("z" dimension) of about 0.25 inch to about 0.75 inch, about 0.375 inch to about 0.625 inch; and a thickness ("y" dimension) of about 0.02 inch to about 0.3 inch, such as about 0.031 inch to about 0.25 inch.

In alternative embodiments, the bolt catch 12 can be configured to move linearly, instead of rotationally, between its released and depressed positions. Also, the linkage between the safety selector 140 and the bolt catch 12 can take a form other than the lever 15. For example, the linkage can be a multi-piece linkage, of any other type of linkage capable of transmitting movement the of the safety selector 140 to the bolt catch 12 so as to move the bolt catch 12 between its released and depressed positions.

As used herein, the term "about" in reference to a numerical value means plus or minus 10% of the numerical value of the number with which it is being used.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A device for selectively preventing discharge of a firearm, the firearm comprising:

a bolt carrier assembly, the bolt carrier assembly comprising a bolt configured to move a cartridge into a chamber of the firearm; a trigger mechanism mounted on the receiver and comprising a spring-biased hammer configured to strike the cartridge, and a trigger lever configured to move between a first position at which the trigger lever restrains the hammer against the spring bias on the hammer, and a second position at which the trigger lever releases the hammer; the device comprising:

a bolt catch comprising a body, wherein the bolt catch is configured to be mounted on the firearm for movement in relation to the firearm between a first position at which the bolt catch is located outside of the path of travel of the bolt carrier assembly thereby permitting the bolt to move the cartridge into the chamber, and a second position at which the body is located at least partially within a path of travel of the bolt carrier assembly of the firearm so as to prevent the bolt from moving the cartridge into the chamber;

a biasing member configured to bias the bolt catch toward the second position of the bolt catch; and a selector configured to be mounted on the firearm and to move in relation to the firearm from a first position to a second position of the selector in response to a force applied to the selector, wherein the selector is further configured to:

move the bolt catch from the second to the first position of the bolt catch in when the selector moves from the first position to the second position of the selector;

return to the first position of the selector in response to the bias of the biasing member when the force applied to the selector is removed;

move between the first position of the selector and a third position of the selector; and prevent movement of the trigger lever from the first to the second position of the trigger lever only when the selector is in the third position of the selector.

2. The device of claim 1, wherein:

the device further comprises a lever mounted on the receiver for movement between a first and a second position, the lever comprising a first end coupled to the bolt catch, and a second end;

the selector is further configured to move the lever from the second to the first position of the lever when the selector moves from the first position to the second position of the selector; and the lever is configured to move the bolt catch from the second to the first position of the bolt catch in response to movement of the lever from the second to the first position of the lever.

3. The device of claim 1, wherein: the second end of the lever is configured to contact a camming surface; and the lever is further configured to move from the second to the first position of the lever in response to movement of the camming surface in relation to the second end of the lever.

4. The device of claim 3, wherein the camming surface is a surface of the selector.

5. The device of claim 4, wherein the selector further comprises a first end portion adjoining the camming surface; a central portion adjoining the camming surface; and a second end portion adjoining the central portion.

6. The device of claim 5, wherein the central portion of the selector is configured to prevent movement of the trigger lever from the first position to the second position of the trigger lever only when the selector is in the third position of the selector.

7. The device of claim 1, wherein the body has a substantially flat major surface configured to engage a head of the bolt when the bolt catch is in the second position, and the engagement of the major surface and the bolt head prevents the bolt from moving the cartridge into the chamber of the firearm.

8. The device of claim 1, wherein the bolt catch is configured to release the bolt carrier assembly when the bolt catch is moved from the second position to the first position of the bolt catch.

9. A firearm, comprising:

a receiver;

a bolt carrier assembly mounted on the receiver and comprising a bolt carrier and a bolt mounted at least partially within the bolt carrier, the bolt being configured to move in relation to the receiver between a rearward position, and a forward position at which the bolt secures a cartridge in a chamber of the firearm;

a trigger mechanism mounted on the receiver and comprising a spring-biased hammer configured to strike the cartridge, and a trigger lever configured to move between a first position at which the trigger lever restrains the hammer against the spring bias on the hammer, and a second position at which the trigger lever releases the hammer;

a bolt catch comprising a body, wherein the bolt catch is configured to be mounted on the receiver for movement in relation to the receiver between a first position at which the bolt catch is located outside of the path of travel of the bolt carrier assembly thereby permitting the bolt to move the cartridge into the chamber, and a second position at which the body prevents the movement of the bolt from the rearward position to the forward position so as to prevent discharge of the firearm;

a biasing member configured to bias the bolt catch toward the second position of the bolt catch; and a selector mounted on the receiver and configured to:

move in relation to the receiver from a first position to a second position of the selector in response to a force applied to the selector;

move the bolt catch from the second position to the first position of the bolt catch when the selector moves from the first position to the second position of the selector;

return to the first position of the selector in response to the bias of the biasing member when the force applied to the selector is removed;

move between the first position of the selector and a third position of the selector; and prevent movement of the trigger lever from the first to the second position of the trigger lever only when the selector is in the third position of the selector.

10. The firearm of claim 9, further comprising a linkage mounted on the receiver for movement between a first and a second position, the linkage comprising a first end coupled to the bolt catch, and a second end contacting the selector; wherein:

the selector is further configured to move the linkage from the second to the first position of the linkage in response to movement of the selector from the first position to the second position of the selector; and the linkage is configured to move the bolt catch from the second position to the first position of the bolt catch in response to movement of the linkage from the second position to the first position of the linkage.

11. The firearm of claim 10, wherein: the selector has a camming surface; the second end of the linkage is configured to contact the camming surface; and the camming surface is configured to move the linkage from the second to the first position of the linkage in response to the movement of the selector from the first position to the second position of the selector.

12. The firearm of claim 11, wherein a distance between an axis of rotation of the selector and a point of contact between the second end of the linkage and the camming surface varies along a length of the camming surface.

13. The firearm of claim 12, wherein the selector further comprises a first end portion adjoining the camming surface; a central portion adjoining the camming surface; and a second end portion adjoining the central portion.

14. The firearm of claim 13, wherein the central portion of the selector is configured to prevent movement of the trigger lever from the first position to the second position of the trigger lever only when the selector is in the third position of the selector.

15. The firearm of claim 10, further comprising a pin secured to the first end of the linkage and configured to engage the body of the bolt catch by way of a slot formed in the body.

16. The firearm of claim 10, wherein the linkage comprises a lever.

17. The firearm of claim 9, wherein the biasing member comprises a plunger comprising a housing, and coil spring configured to be positioned at least partially within the housing.

18. The firearm of claim 9, wherein the bolt catch is further configured to be located outside of the path of travel of the bolt carrier assembly when the bolt catch is in the first position thereby permitting the bolt to move the cartridge into the chamber.

19. The firearm of claim 9, wherein the bolt catch is further configured to rotate between the first and the second positions.

20. The firearm of claim 9, wherein the bolt catch is configured to release the bolt when the bolt catch is moved from the second position to the first position of the bolt catch.

* * * * *